US007637194B2

(12) United States Patent
Gude et al.

(10) Patent No.: US 7,637,194 B2
(45) Date of Patent: Dec. 29, 2009

(54) METHOD AND DEVICE FOR DISMANTLING EXPLOSIVES-CONTAINING BODIES

(75) Inventors: Gerd Gude, Luppa (DE); Ernst Kschamer, Burg (DE); Waldemar Lehmann, Waldow/Brand (DE); Rudolf Meinhardt, Sueptitz (DE); Holger Philipp, Luebben (DE); Hans-Juergen Poehla, Gross Leulhen (DE); Hans-Georg Tritsch, Berlin (DE); Gert Von-Wickede, Dresden (DE)

(73) Assignee: Spreewerk Luebben GmbH, Leubben (DE)

( * ) Notice: Subject to any disclaimer, the term of this patent is extended or adjusted under 35 U.S.C. 154(b) by 506 days.

(21) Appl. No.: 11/176,340

(22) Filed: Jul. 8, 2005

(65) Prior Publication Data

US 2006/0236851 A1 Oct. 26, 2006

(30) Foreign Application Priority Data

Jul. 9, 2004 (DE) ..... 10 2004 034 784

(51) Int. Cl.
*F42B 33/06* (2006.01)

(52) U.S. Cl. ..... 86/50; 86/49; 588/403

(58) Field of Classification Search ..... 86/49, 86/50; 588/403
See application file for complete search history.

(56) References Cited

U.S. PATENT DOCUMENTS 4,418,591 A * 12/1983 Astle ..... 82/113
4,665,782 A * 5/1987 Vander Pol ..... 82/113
5,515,756 A * 5/1996 Sandford et al. ..... 82/54
5,941,466 A * 8/1999 Alba et al. ..... 241/1
6,470,783 B2 * 10/2002 Ito et al. ..... 86/50
6,886,444 B2 * 5/2005 Reid ..... 86/50
7,249,553 B1 * 7/2007 Gaudre et al. ..... 86/50

FOREIGN PATENT DOCUMENTS

DE 4140001 2/1993
DE 4221666 1/1994
DE 4221666 C1 * 1/1994

(Continued)

OTHER PUBLICATIONS

Full English Translation of DE 4221666 C1, Germany, Jan. 1994, Wilhelm et al., translated by FLS, Inc. for the United States Patent and Trademark Office in Dec. 2008.*

*Primary Examiner*—James S Bergin
(74) *Attorney, Agent, or Firm*—Greenblum & Bernstein, P.L.C.

(57) ABSTRACT

The invention relates to the field explosives technology and concerns a method and a device in which the explosive materials are removed from their casings.

The object of the solution according to the invention is to disclose a method and a device with which explosives-containing bodies with non-uniform dimensions and also with internal attachments can be safely opened and dismantled.

The object is attained through a method in which a strip of casing material is removed up to a residual wall thickness by means of machining tools, subsequently pressure is applied on the casing by means of a pressing tool and then the explosive material is removed from the casing by means of melting or by means of pressing.

The object is further attained through a device comprising a device for removing a chip and a device for applying pressure on the explosives-containing bodies and devices for transporting the explosives-containing body.

25 Claims, 1 Drawing Sheet

FOREIGN PATENT DOCUMENTS

| | | | | |
|---|---|---|---|---|
| DE | 4337003 | C1 | * | 12/1994 |
| DE | 19517760 | | | 11/1996 |
| DE | 19736298 | | | 2/1999 |
| DE | 19914688 | | | 7/2001 |
| DE | 10251105 | | | 5/2002 |
| DE | 10129016 | | | 12/2002 |
| DE | 20215938 | | | 3/2003 |
| DE | 10245512 | | | 2/2004 |
| GB | 2336804 | A | * | 11/1999 |
| JP | 2002 048499 | A | * | 2/2002 |
| WO | 99/28700 | | | 6/1999 |
| WO | 99/34165 | | | 7/1999 |

* cited by examiner

METHOD AND DEVICE FOR DISMANTLING EXPLOSIVES-CONTAINING BODIES

CROSS-REFERENCE TO RELATED APPLICATIONS

The present application claims priority under 35 U.S.C. §119 of German Patent Application No. 10 2004 034 784.0, filed on Jul. 9, 2004, the disclosure of which is expressly incorporated by reference herein in its entirety.

BACKGROUND

The invention relates to the fields of process engineering and explosives technology and concerns a method and a device for dismantling explosives-containing bodies, in which the explosive materials are removed from their casings.

In the known methods for removing explosive materials from their casings, in particular from military objects, the casings and objects are first opened so that the explosive material is openly accessible. Opening the casings and objects is either already provided for in structural terms or it usually takes place at the detonator housing or the feed opening. Subsequently, in many cases the explosive materials are melted out if they themselves are meltable or contain meltable components.

A method is known for opening explosives-containing bodies for the environmentally safe disposal of ammunition in which the bullet case is cut open tangentially up to a residual wall thickness by means of a compressed water jet with integrated grinding particles (DE 42 21 666 C1). The ammunition is then separated by the application of bending and/or torsional forces. The ammunition then breaks into two parts at the breaking point predetermined by the residual wall thickness.

Furthermore, a method is known for disassembling and reassembling projectiles in which bomblets of a first caliber are inserted into a projectile of a second caliber to be reassembled (DE 195 17 760 A1).

Various other methods for dismantling ammunition or grenades are likewise known (WO 99/34165; DE 197 36 298 A1; DE 102 45 512 B3; DE 102 51 105 A1; DE 41 40 001 C1; WO 99/28700; DE 202 15 938 U1).

A method is likewise known for removing an explosive charge from hollow-charge ammunition (DE 199 14 688 C2). Accordingly, a hollow punch die is guided through the open end of the jacket of the ammunition and into the explosive material and subsequently the explosive material is released by means of a vacuum.

A disadvantage of all these methods is the complicated process technology, e.g., the complicated supply and removal of water with the grinding particles and the necessary precise control of the process, in particular with regard to dimensions of the water jet and its guidance during the cutting operation. Likewise the insertion of a hollow punch die into the ammunition and the explosive material is possible only under special safety conditions, and additional devices are necessary for the application of a vacuum.

Furthermore, a method and a device for removing explosive materials are known (DE 101 29 016 A1). Accordingly, the casing is opened respectively in the area of the largest cross section of the geometry of the interior of the casing. As is known, this can be done by separating, cutting, sawing or breaking. Subsequently, the totally or partially meltable explosive material is heated in the contact area with the casing so that it is released from the casing and can be removed in a separate vessel.

A disadvantage here is that a high expenditure in terms of time and energy is necessary for removing the explosive material.

The object of the solution according to the invention is to disclose a method and a device for dismantling explosives-containing bodies with which explosives-containing bodies with non-uniform dimensions and also with internal attachments can be safely opened and dismantled.

The object is attained through the invention disclosed in the claims. Further developments are the subject matter of the subordinate claims.

BRIEF DESCRIPTION OF THE DRAWING

The FIGURE schematically illustrates an embodiment of the device according to the present invention.

DETAILED DESCRIPTION OF THE INVENTION

Figure 1:
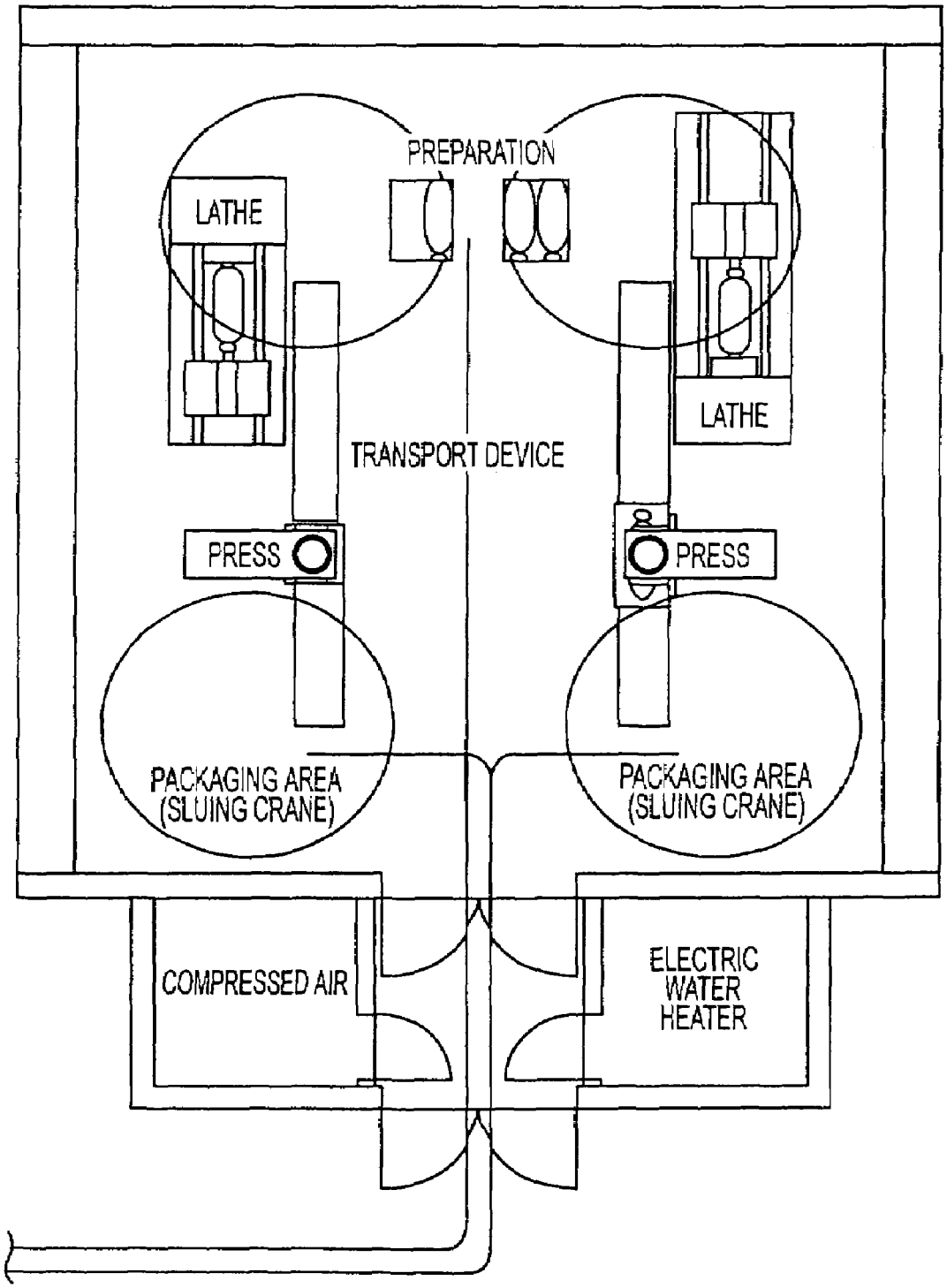

In the method for dismantling explosives-containing bodies according to the invention, the explosives-containing bodies are set in motion rotating about their longitudinal axis, and a strip of casing material is removed by means of machining tools at one or more points distributed over the length of the explosives-containing body. The removal of a respectively equal chip thickness is realized and the casing material is removed only up to a residual wall thickness by guiding the machining tool. Subsequently, pressure is applied on the casing by means of a pressing tool and then the explosive material is removed from the casing by means of melting or by means of pressing.

Advantageously, bombs and grenades are dismantled as explosives-containing bodies.

Likewise advantageously, the explosives-containing bodies are clamped axially on a lathe and set in motion rotating about their longitudinal axis, whereby a lathe tool is used as a machining tool.

Furthermore advantageously, a chip the width of a lathe tool is removed from a metal casing of an explosives-containing body.

Also advantageously, the guidance of the machining tool is realized through a fixed stop to maintain the spacing between tool holder and casing surface or through a sensor to measure the spacing between tool holder and casing surface, whereby, through the fixed stop or the sensor, the minimum wall thickness of the metal casing is maintained and the explosive material is not exposed even with non-rotationally symmetrical explosives-containing bodies and/or non-uniform wall thicknesses.

It is also advantageous if the control of the mechanical feed drive of the machining tool is overlaid by the fixed stop or by the sensor control of a compressed-air cylinder to realize the residual wall thickness, whereby the machining tool cannot penetrate into the explosive material.

It is likewise advantageous if the removal of the chip is realized at two positions over the length of the explosives-containing body, whereby the removal of the chip is realized at both of the positions respectively in the area of the greatest diameter of the explosives-containing body.

It is furthermore advantageous if the chip removal is realized up to a residual wall thickness that is 5 to 15% of the wall thickness of the casing.

It is also advantageous if the explosives-containing body is transported onto a separate device for the application of pressure to the casing, whereby the explosives-containing bodies are transported onto a press for the application of pressure to the casing.

It is also advantageous if the pressure application is realized at respectively two opposite points on the casing and at least over the areas at which one or more chips have been removed from the casing.

It is likewise advantageous if the introduction of pressure on the grooves formed in the casing by the removal of the chips is realized via devices on the holder and the pressing tool.

It is likewise advantageous if, after the pressure has been introduced, the two or more parts formed of the explosives-containing body are separated from one another by the application of tensile forces, whereby the pulling apart of the parts formed of the explosives-containing body is realized on a press, whereby a stoppage of the press in the lower reversal point is defined in terms of time and a holding of the center part is realized and/or whereby existing internal attachments in the explosives-containing body are separated by pulling apart the parts of the explosives-containing body formed.

Also advantageously, after at least two parts of the explosives-containing body have been produced, they are heated until the surface of the explosive material melts in the area of the contact with the casing and the removal of the explosive material from the casing is thus realized and/or after at least two parts of the explosives-containing body have been produced, pressure is once again applied to the casings, whereby the explosive material is removed from the casing in part broken up.

It is furthermore advantageous if after at least three parts of the explosives-containing body have been produced, the explosive material is removed from the respective central part in which the casing has an essentially equal diameter, in that pressure is applied to the explosive material, whereby the explosive material is removed from the casing broken up.

The device according to the invention for dismantling explosives-containing bodies comprises a device for removing a chip from the casing of an explosives-containing body and a device for applying pressure to the explosives-containing bodies and comprises devices for transporting the explosives-containing body to and from a device component to and from another device component.

Advantageously, the device for removing a chip from the casing of an explosives-containing body is a lathe.

Likewise advantageously, the device for applying pressure to the explosives-containing bodies is a press.

It is furthermore advantageous if the entire device is positioned in a chamber which complies with the safety requirements for the dismantling of explosives-containing bodies.

It is also advantageous if the transport device is simultaneously the pressing tool.

It is also advantageous if a laser system is available for positioning the explosives-containing bodies.

Accordingly, the present invention provides a method and device for dismantling a body containing explosive material. The method for dismantling a body containing explosive material in which the body comprises a casing material having a thickness, comprises rotating the body about a longitudinal axis, removing with a machine tool at least one strip of the casing material to a residual wall thickness less than the thickness of the casing, the depth being substantially constant, applying pressure on the casing, and removing the explosive material by melting or pressing. The device for dismantling a body containing explosive material, in which the body comprises a casing material, comprises a device component for removing a strip from the casing material of the body, a device component for applying pressure to the body, and transporter components for transporting the body to and from device components.

In preferable embodiments, the body may comprise at least one of a bomb or a grenade. In preferred embodiments, the body is not rotationally symmetric and/or has non-uniform wall thickness.

Preferably, the body is clamped axially on a lathe that sets the body in motion rotating about the longitudinal axis. Preferably, the machine tool comprises a lathe tool, and preferably, the lathe tool has a width, and the at least one strip has the width of the lathe tool.

Preferably, the machine tool is guided through a fixed stop that maintains the spacing between a tool holder and the surface of the casing material, or through a sensor that measures spacing between a tool holder and the surface of the casing surface. The fixed stop or the sensor preferably maintains a minimum residual wall thickness, whereby the explosive material is not exposed.

The residual wall thickness is preferably obtained by controlling a mechanical feed drive of the machining tool, which is overlaid by the fixed stop or the sensor control of a compressed-air cylinder, whereby the machine tool does not penetrate into the explosive material.

In preferred embodiments, at least two strips are removed. Preferably, the body has at least one diameter, and at least two strips are removed from two positions in the area of greatest diameter of the explosives-containing body.

Preferably, the residual wall thickness is 5 to 15% of the wall thickness of the casing.

The body is preferably transported to a device other than the machine tool, preferably a pressing tool, for the application of pressure to the casing. The pressure is preferably applied at two opposite points on the casing material, and over at least one of the strips. The pressure is preferably applied on the strips.

The body is preferably separated into two or more parts, and after the pressure begins to be applied, the parts are preferably separated from one another by the application of tensile forces. The parts are preferably separated on a press, and, to hold one of the parts, the press preferably stops at a lower reversal point defined in terms of time.

Existing internal attachments in the body are preferably separated by pulling apart the parts.

When the explosive material is removed by heating, the parts are preferably heated to melt the explosive material in an area of contact with the casing material to remove the explosive material from the casing.

When the explosive material is removed by pressure, preferably, after the body is separated, pressure is applied to the parts to remove the explosive material. When at least three parts of the explosives-containing body are produced, a central part preferably having essentially equal diameter and containing the explosive material, the explosive material is preferably removed from the central part by applying pressure to the explosive material.

The device component for removing a strip from the casing material of the body component preferably is a lathe.

The device component for applying pressure to the body preferably is a press. The device component for applying pressure to the body preferably comprises a transporter component.

The device is preferably positioned in a chamber which complies with safety requirements for the dismantling of explosives-containing bodies.

The device preferably further comprises a laser system for positioning the body.

Through the solution according to the invention it is possible to safely dismantle explosives-containing bodies, in particular with larger dimensions. According to the invention, dismantling means the essentially complete removal of the explosive material from its casing.

The production of explosives-containing bodies with larger dimensions evidently did not make any greater demands on the dimensional consistency of the casings. A safe opening has therefore hitherto still been difficult in terms of safety technology. Through the method according to the invention, the surfaces of the explosives-containing bodies are measured and/or scanned during the machining so that the machining tool can adjust its spacing from the respective surface during machining by changing the distance. A respectively equal chip thickness can be thus realized and the maintenance of a residual wall thickness equal all around.

After this preparation of the explosives-containing body, it is transported onto a press and positioned there on a special device, advantageously one or two cutting edge-like holders which fit into the turned-out grooves. The pressing tool likewise has one or two cutting edge-like devices which likewise fit in the turned out grooves. The casing is thus opened in the area of the grooves by applying pressure.

Subsequently, a tensile force can be applied on the formed parts of the explosives-containing body to separate the parts and in particular to separate existing internal attachments in the explosives-containing bodies.

In order to remove the explosive material, it can be melted out, as is known. In the case of dividing the explosives-containing body into three or more parts, the explosive material can also be pressed out of the parts which have an essentially equal diameter of the casing throughout. To this end these parts are placed in a press and the pressing tool applies a pressure to the explosive material such that this is removed from the casing. The press for realizing this removal of the explosive material can be the device part belonging to the device according to the invention or a separate device.

The only FIGURE schematically illustrates an embodiment of the device according to the present invention. The device comprises a lathe for rotating and machining the explosives-containing body, a press for applying pressure to the machined body and a transport device for transporting the body from the lathe to the press. Also shown is an optional packaging area (including a sluing crane) for the explosive material recovered from the body.

The invention is described in more detail below on the basis of an exemplary embodiment.

EXAMPLE

An explosive bomb with a caliber of 1,000 lbs which is filled with 240 kg explosive material (amatol) as effective charge has a rotationally symmetrically interior. Two transport eyebolts are mounted on the outer surface. This undetonated bomb is pneumatically clamped in a lathe and set in a rotational movement about its longitudinal axis. The concentricity is thereby checked. The starting point for the lathe tool is automatically established with the concentricity check.

Subsequently every 10 mm a chip is simultaneously removed next to the two transport eyebolts by the lathe tool and respectively a groove up to 10% of the wall thickness of the casing is routed. A fixed stop prevents the casing from being severed and the lathe tool from running into the explosive material.

After the formation of the two grooves, the bomb is placed on a transport carriage and pushed further to a press (compressive force 2,500 KN) via a roller path. The transport carriage simultaneously serves as the lower pressing tool. Standing under the press, the bomb is aligned for the following breaking operation with the aid of a fixed-mount laser system.

During breaking, the bomb body is broken into three parts by means of four cutting edges integrated into the upper and lower pressing tool.

After the breaking the three bomb parts now available come under a further press respectively individually. There the parts are subjected to a pressure loading so that the explosive material breaks and is removed.

Subsequently, the empty bomb casing part is checked for complete removal of the explosive material.

The invention claimed is:

1. A method for dismantling a body containing explosive material in which the body comprises a casing material having a thickness, the method comprising rotating the body about a longitudinal axis, removing with a machine tool at least two strips of the casing material to a residual wall thickness less than the thickness of the casing, the depth being substantially constant, opening the casing by applying pressure on the casing, and removing the explosive material by melting or pressing.

2. The method of claim 1 wherein the body comprises at least one of a bomb or a grenade.

3. The method of claim 1 wherein the body is clamped axially on a lathe that sets the body in motion rotating about the longitudinal axis.

4. The method of claim 1 wherein the machine tool comprises a lathe tool.

5. The method of claim 4, wherein the lathe tool has a width, and the at least one strip has the width of the lathe tool.

6. The method of claim 1 wherein the machine tool is guided through a fixed stop that maintains the spacing between a tool holder and the surface of the casing material, or through a sensor that measures spacing between a tool holder and the surface of the casing surface.

7. The method of claim 6, wherein the fixed stop or the sensor maintains a minimum residual wall thickness, whereby the explosive material is not exposed.

8. The method of claim 7 wherein the body is not rotationally symmetric and/or has non-uniform wall thickness.

9. The method of claim 6 wherein the residual wall thickness is obtained by controlling a mechanical feed drive of the machining tool, which is overlaid by the fixed stop or the sensor control of a compressed-air cylinder, whereby the machine tool does not penetrate into the explosive material.

10. The method of claim 1 wherein the body has at least one diameter, and the at least two strips are removed from two positions in the area of greatest diameter of the explosives-containing body.

11. The method of claim 1, wherein the residual wall thickness is 5 to 15% of the wall thickness of the casing.

12. The method of claim 1, wherein the body is transported to a device other than the machine tool for the application of pressure to the casing.

13. The method of claim 12, wherein the device for the application of pressure to the casing comprises a pressing tool, and the body is transported to the pressing tool.

14. The method of claim 1, wherein the pressure is applied at two opposite points on the casing material, and over at least one of the strips.

15. The method of claim 1, wherein the pressure is applied on the strips.

16. The method of claim 1 wherein the body is separated into three or more parts, and after the pressure begins to be applied, the parts are separated from one another by the application of tensile forces.

17. The method of claim 16, wherein the parts are separated on a press, and, to hold one of the parts, the press stops at a lower reversal point.

18. The method of claim, 16, wherein existing internal attachments in the body are separated by pulling apart the parts.

19. The method of claim 16, wherein after the body is separated, the parts are heated to melt the explosive material in an area of contact with the casing material to remove the explosive material from the casing.

20. The method of claim 16, wherein after the body is separated, pressure is applied to the parts to remove the explosive material.

21. The method of claim 16, wherein after at least three parts of the explosives-containing body have been produced, a central part having essentially equal diameter and containing the explosive material, the explosive material is removed from the central part by applying pressure to the explosive material.

22. A device for dismantling a body containing explosive material, in which the body comprises a casing material, comprising, a device component for removing at least two strips from the casing material of the body, a device component for applying pressure to the body, and transporter components for transporting the body, wherein the device component for applying pressure to the body comprises a transporter component of the transporter components.

23. The device of claim 22, wherein the device component for removing a strip from the casing material of the body component is a lathe.

24. The device of claim 22, wherein the device is positioned in a chamber which complies with safety requirements for the dismantling of explosives-containing bodies.

25. The device of claim 22 further comprising a laser system for positioning the body.

* * * * *